United States Patent [19]

Anderson

[11] Patent Number: 4,829,974

[45] Date of Patent: May 16, 1989

[54] ARCHERY ARROW AND ARROW LAUNCHING DEVICE

[76] Inventor: Jeffrey R. Anderson, 162 Slocum Lake Rd., Wauconda, Ill. 60084

[21] Appl. No.: 80,019

[22] Filed: Jul. 31, 1987

[51] Int. Cl.[4] ..... F41B 5/00; A63B 65/02

[52] U.S. Cl. ..... 124/24 R; 124/41 A; 124/41 R; 124/83; 124/88; 273/416

[58] Field of Search ..... 124/23 R, 24 R, 26, 124/41 R, 41 A, 82, 83, 84, 86, 88–91; 273/416–423; 102/520, 521

[56] References Cited

U.S. PATENT DOCUMENTS

| | | | |
|---|---|---|---|
| 1,210,332 | 12/1916 | Kvistad | 124/24 R |
| 1,526,176 | 2/1925 | O'Connell . | |
| 1,989,847 | 2/1935 | Cowdery | 273/416 |
| 3,855,991 | 12/1974 | Imatt et al. | 124/24 R |
| 4,027,645 | 6/1977 | Damron | 124/24 R |
| 4,146,009 | 3/1979 | Adams | 124/24 R X |
| 4,290,407 | 9/1981 | Damron | 124/41 A |
| 4,385,618 | 5/1983 | Nishioka | 124/24 R |
| 4,446,844 | 5/1984 | Nishioka | 124/41 A |

FOREIGN PATENT DOCUMENTS

| | | | |
|---|---|---|---|
| 400837 | 4/1966 | Switzerland | 273/419 |

*Primary Examiner*—Randolph A. Reese
*Assistant Examiner*—John Ricci
*Attorney, Agent, or Firm*—Lockwood, Alex, FitzGibbon & Cummings

[57] ABSTRACT

A reciprocable barrel-like device for mounting on an archery bow for accurately guiding the launch of special arrows which are substantially shorter and lighter than conventional arrows and equipped with at least one sabot. The device may also include elements for removing, breaking or severing rubber bands or other retainers which releasably retain multi-part sabots on the shafts of arrows and which fall away as the arrows are launched into free flight trajectories. In addition to a barrel-like launching guide the device includes elements for mounting the barrel of the device onto a bow so that the device and an arrow disposed therein may be drawn back in unison with the bow string during the drawing or cocking action. The arrows shoot through the retracted barrel-like guide when the bow string is released.

18 Claims, 3 Drawing Sheets

FIG. 1
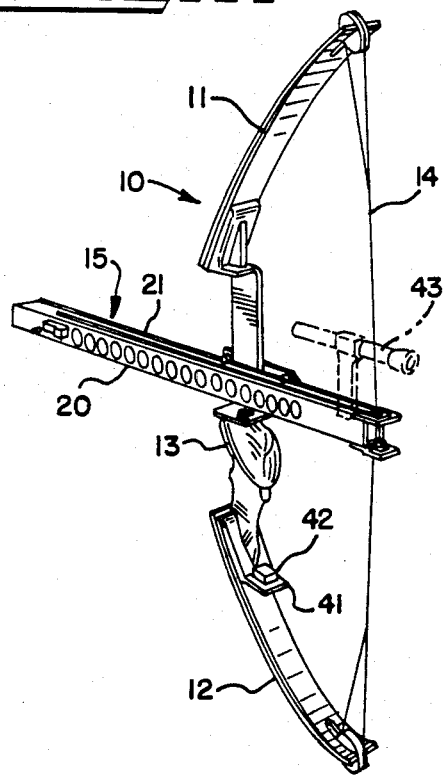
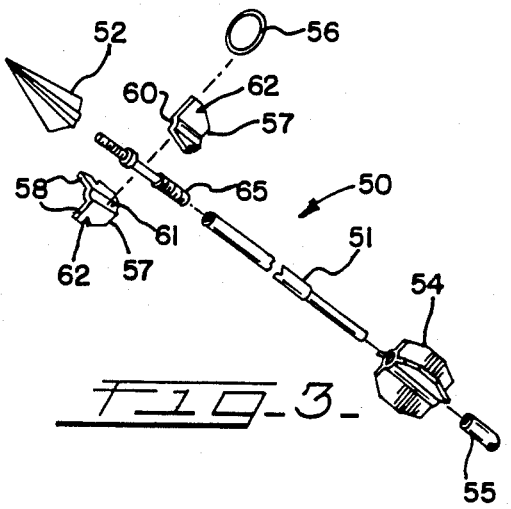
FIG. 3
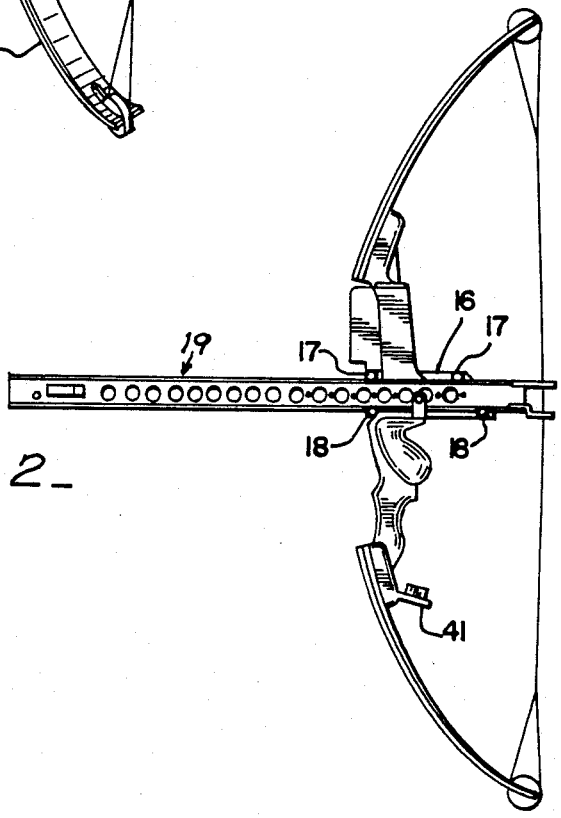
FIG. 2

FIG. 11
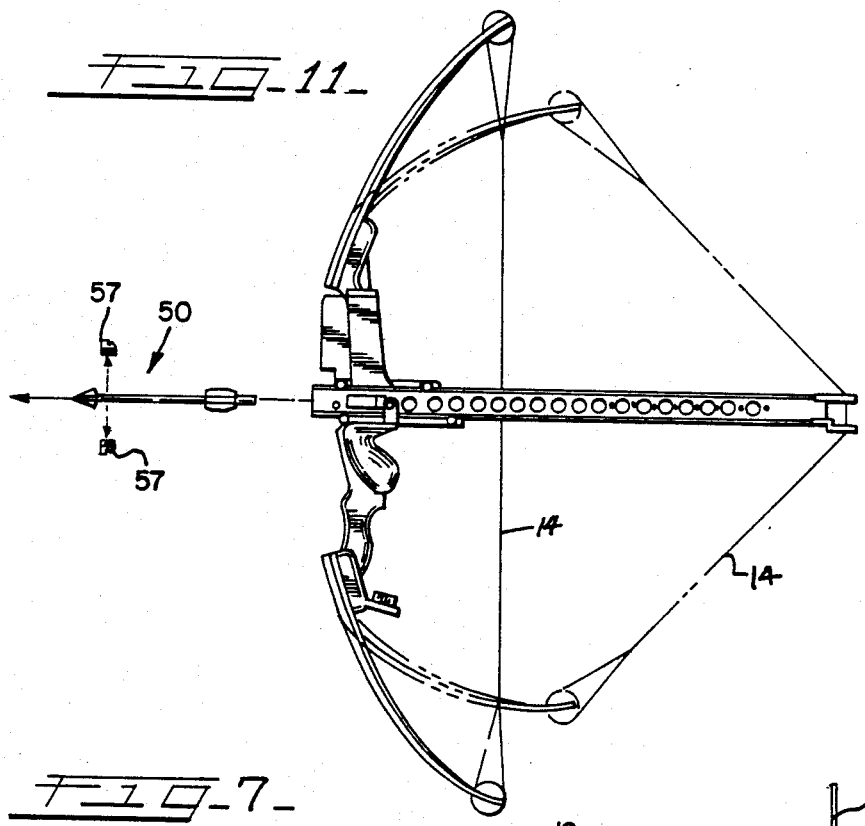
FIG. 7
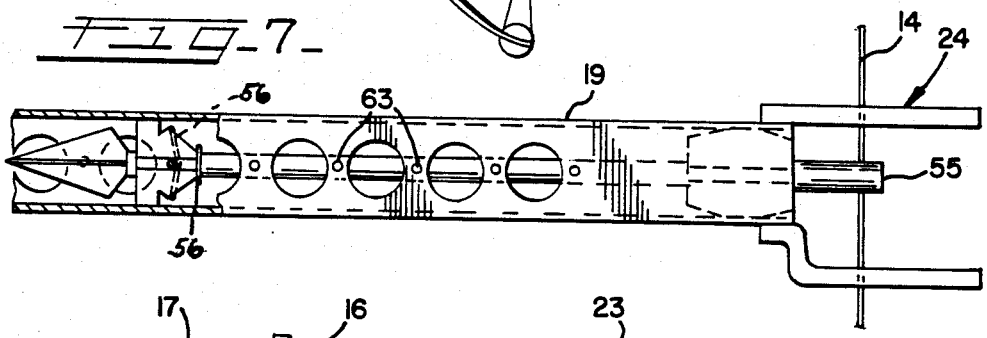
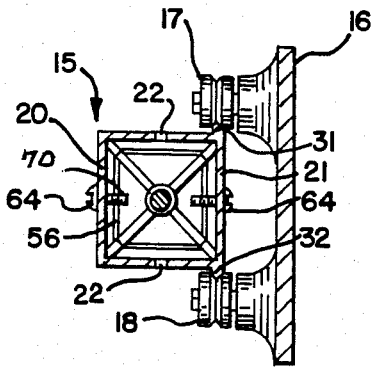
FIG. 9
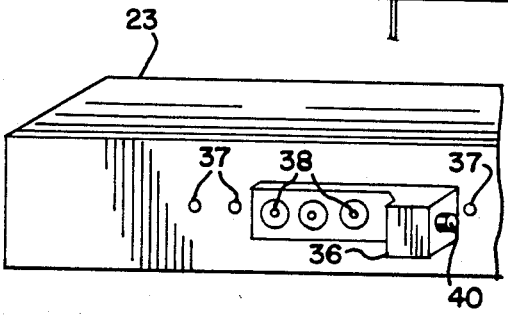
FIG. 10

ARCHERY ARROW AND ARROW LAUNCHING DEVICE

This invention relates generally to a new and improved launching device for archery arrows adapted to be mounted on an archery bow of the conventional type and to new and improved arrows for use therewith. More particularly, the invention relates to a barrel-like device for mounting so as to have reciprocal movement on an archery bow for accurately guiding the launch of arrows which preferably are substantially shorter and lighter than the arrows which would conventionally be used with the bow. Each arrow is provided adjacent the tip or front end thereof with a sabot which if desired, may be releasably secured to the arrow by means which are removed, severed or broken as the arrow exits from the muzzle end of the launching barrel. In addition, each arrow may also be provided with a sabot at the nock end which becomes detached from the shaft of the arrow as the shaft passes through a target.

The prior art embodied in U.S. Pat. No. 4,290,407 issued Sept. 22, 1981 to William M. Damron discloses an archery arrow launching device for use in shooting short, but otherwise conventional arrows and which includes a stationarily mounted hollow tube having a through-bore sized to accommodate the shaft of a conventional arrow. The barrel of the Damron device also has diametrically opposed slots extending radially from the through-bore for the length of the barrel or tube which accommodate the fletchings at the nock end of the arrow and also the sharp edges of the broad head tip of a hunting arrow.

The arrow launching and guiding means of the present invention includes a reciprocally-mounted barrel that has an opening or bore of uniform cross-section extending from its breach end through its muzzle end which is substantially larger than the shaft cross-section of the arrows used therewith, and which opening or bore is sized so as to have guiding contact with the outer or tip edges of the fins on a sabot carried by the front end of the arrow and also with the conventional fletchings at the nock end or with the fins on a sabot carried at the nock end of the arrow. A multi-part sabot mounted on an arrow is maintained in assembled relationship on the arrow shaft by suitable means such as a rubber band or other severable retainer which becomes removed, severed or broken by engagement with projections protruding into tee barrel. Since the rubber bands or other means for holding the parts of the sabot in assembled relationship on the shaft of the arrow are no longer effective after being removed, severed or broken the multi-part sabot falls off from the arrow in separate pieces as soon as it exits the muzzle end thereof.

Since substantially shorter than conventional arrows are best suited for use with the new and improved launching and guiding device of the present invention, the reduced mass or weight of the shorter arrows results in their being launched with substantially greater velocity than normal arrows as the energy provided by the bow is utilized to impart increased acceleration and velocity to the shorter arrows. Because of the substantially increased velocity and the guidance provided by the launching device of the present invention, the shorter arrows will have improved accuracy over greater ranges than normal arrows with flatter trajectories and shorter flight times.

The object of the invention, generally stated, is the provision of a device including a reciprocal barrel to be mounted on a conventional type archery bow add which will accommodate sabot-equipped arrows which are shorter than conventional arrows and which device provides accurate guidance as the shorter arrows are launched at higher than normal velocities with flatter trajectories.

Another object of the invention is an archery device of the foregoing type which: (1) is safe to shoot short arrows since entire arrow including all sharp edges is confined within the reciprocal barrel; (2) is compatible with a telescopic sight since the line of sight of scope is permanently fixed in relation to path of the arrow; (3) does not use a rest for the arrow to rest on and which flicks the rear of the arrow from its desired path when it it fired; (4) incorporates an adjustable full draw stop so that the bow string is pulled back exactly the same amount every shot; and, (5) permits the barrel to be readily placed in a stowed position.

A further object of the invention is the provision of arrows which are shorter than conventional arrows and which are provided with one or more sabots that provide guidance to the arrows during their launch and which may be of the type to fall off from the arrows as they exit from the muzzle end of the barrel of a guiding and launching device with which they are used.

Additional objects of the invention will become apparent from the following detailed description of a presently preferred embodiment of the invention taken in connection with the accompanying drawings, wherein:

FIG. 1 is a perspective view of one form a conventional archery bow to which has been mounted or attached a barrel-like device for guiding the launch of an arrow in accordance with present invention;

FIG. 2 is a side elevational view of the bow and barrel-like device shown in FIG. 1;

FIG. 3 is an exploded view of an arrow incorporating the present invention and adapted to be launched from and by the guiding and launching device shown in FIGS. 1 and 2;

FIG. 7 is a fragmentary side elevational view, partly broken away, showing a short arrow fully inserted in the barrel-like device;

FIG. 9 is a vertical section view on enlarged scale taken on line 9—9 of FIG. 8;

FIG. 10 is a fragmentary perspective view showing the muzzle end of the barrel of the arrow guiding and launching device; and, FIG. 11 is a side elevational view showing in broken line the limbs of the bow in their drawn condition and showing an arrow leaving from the barrel of the guiding and launching device with the sabot components separating from the arrow.

Figure 5:
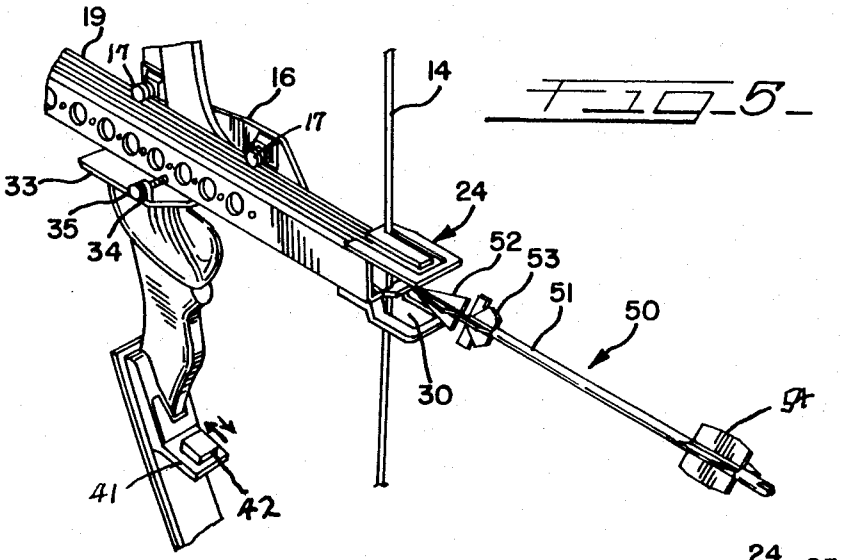
FIG. 5 is a fragmentary perspective view showing the insertion of an arrow conforming to FIG. 3 into the breach end of the barrel-like guiding and launching device.
Figure 8:
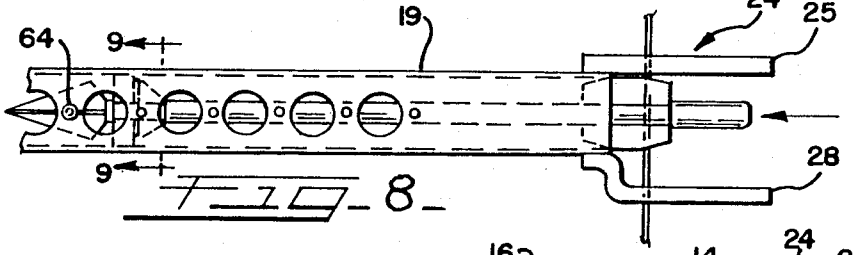
FIG. 8 is a fragmentary side elevational view similar to FIG. 7 showing the nock of the arrow fully retracted.

In FIGS. 1, 2, 4 and 11 a typical or conventional bow of known commercial type is indicated generally at 10 comprising upper and lower limbs 11 and 12, respectively, extending in opposed directions from an intermediate riser or handle section 13. A bow string 14 is secured to tee outer extremities of the limbs 11 and 12 in known manner. A barrel-like arrow guiding and launching device is indicated generally at 15, constructed in accordance with the present invention and rigidly mounted on the side of the riser or handle 13 which preferably has been modified so as to incorporate a bearing plate 16 integrally formed as part of the riser 13 and forming a component of the guiding and launching device 15. The bearing plate 16 could be a separate piece attached to the handle 13 at its spine point by means of fasteners.

The bearing plate 16 carries in vertical alignment on one side a pair of grooved upper rollers 17—17 and a pair of lower grooved rollers 18—18.

The barrel-like device 15 comprises a barrel 19 formed by a pair of elongated channel members 20 and 21 which are vertically oriented and which have the opposing sides of the channels turned or facing toward each other and spaced apart so as to provide an elongated groove 22 (FIG. 6) which accommodates the draw string 14. The channel members 20 and 21 are joined together at the muzzle end of the device 15 by a relatively short tube-like member 23 of square cross-section and are joined together at the breach end by a part 24 (FIGS. 5, 6, 7 and 8). The muzzle 23 may be integrally formed as part of the barrel 19. The part 24 serves as a keeper or retainer for holding the bow string 14 out of the way while loading an arrow into the barrel so the sharp cutting edges on the arrowhead do not cut the string. The part or frame 24 also provides a space or opening to grip the nock of an arrow and release the bow string at the proper time. In addition, the part 24 also serves to secure together the channel parts 20 and 21 at the breach end of the barrel device 15. The part or fitting 24 has an upper section 25 which is provided with a slot 26 (FIG. 6) which is aligned with and forms a continuation of the slot 22 in the barrel 15. The slot 26 is interconnected with a bow string retaining or rest slot 27. The bottom section 28 of the attachment 24 is an open frame so as to remove unnecessary weight and have fewer surfaces for bow string 14 to rub against and wear out prematurely.

The vertical side of the channel 21 forming one side of the barrel 19 is provided with ribs 31 and 32 (FIG. 9) so as to provide guided retention of the barrel 15 between the bearing rollers 17—17 and 18—18 as the barrel 15 is drawn back to the rear position shown in FIG. 11 and then advanced to its forward position as shown in FIGS. 1 and 2.

A horizontal flange or plate 33 (FIGS. 5 and 6) extends from the bottom of the mounting plate 16 to the outside of the barrel 19 and is provided with an upturned or vertical ear 34 provided with a threaded opening for receiving a headed screw 35 which serves as a bumper stop when engaged by a full draw bumper 36 (FIG. 6) so as to thereby limit the full draw of the bow string 14. The bumper 36 is secured by screws 38—38 (FIG. 10) to the muzzle 23 of the barrel 19 and series of a threaded openings 37—37 in the side of the muzzle 23 allows the bumper to be adjustably positioned forwardly or rearwardly depending upon the desires of the archer. Tee bumper 36 is preferably provided with a cushion or bumper 40 which comes into actual engagement with the bumper stop 35.

In order to allow the barrel 19 to be folded for convenient carrying or stowage, tee handle 13 of the bow is provided with a muzzle clip 41 (FIGS. 1, 2 and 4) which carries a plug 42 adjustable as indicated by the arrows (FIG. 5) and is dimensioned so as to have a friction or snug fit in the end of the muzzle 23. When it is desired to fold the barrel 1 and put it in the folded position shown in FIG. 4, the bumper stop 35 is unscrewed sufficiently to allow the barrel 19 to be rolled back out of contact with the front rollers 17 and 18 so it can be folded. It will be noted that the rear grooved rollers 17 and 18 are so spaced with respect t their relative vertical positions so as to receive the folded barrel 19 therebetween. The adjustment of the plug 42 secures the barrel 19 between the rear rollers 17 and 18. This three-point retention of the barrel 19 between the rear guide rollers 17 and 18 and the muzzle end by the clip 41 allows the assembly to be handled and carried without relative movement between the barrel 19 and bow 10.

If desired, a telescopic sight 43 (FIG. 1) may be mounted on either the barrel 19 or riser 13 so as to permit greater accuracy in shooting arrows from the bow 10 since the line of sight of the scope is permanently fixed in relation to the flight path of the arrows.

The arrows to be used with and shot from the bow 10 through the barrel 19 are of special construction and are indicated at 50 in FIGS. 3, 5 add 11. These arrows have a length which may be approximately $\frac{1}{3}$ of the length of conventional arrows that would normally be used with the bow 10. However, the arrows can be either longer or shorter. In addition to the arrow shaft 51 and the front end 52 of the arrow, the arrows 50 are provided adjacent the tip or front end or incorporated in it with a releasable sabot 53 (FIG. 5) which separates from the arrow as it leaves the barrel 15 as illustrated in FIGS. 3 and 11. If desired, the sabot 53 can be non-releasable. In addition, it is desirable to provide the nock end of the arrow 50 with a sabot 54 which may separate from the shaft 51 of the arrow as the shaft passes through a target if used for guidance. If not so used it may be designed to fall off after firing. The rear sabot 54 may have fins which are angled so as to impart a spin to the arrow for greater accuracy. The nock of the arrow 50 is indicated at 55. If desired, the sabot 54 may be omitted and the arrow 50 may be equipped with conventional fletchings. The nock 55 may be attached to the shaft 51 or the rear sabot 54 or pop off when the arrow is fired.

The sabot 53 is shown formed in two parts which upon mating together on opposite sides of the arrow shaft 51 are secured in place by suitable means such as a rubber band 56 (FIG. 3) The two segments of the sabot 53 are indicated at 57—57 and each is integrally formed so as to have fins 58—58 extending at right angles to each other interconnected by an integrally formed section 60 provided with a groove 61 which is semicylindrical in shape so as to fit one half of the sabot insert 65 mounted on the arrow shaft 51. The rubber band 56 is retained in place in the notches 62 in the fins 58.

The vertical sides of the channel members 20 and 21 of the barrel 19 are provided with a series of threaded holes 63—63 (FIGS. 7 and 8) for receiving therein a pair of diametrically opposed screws 64—64 (FIG. 9). The shanks or stems of the screws 64 protrude sufficiently far into the barrel 19 so as to engage the vertical sides of the rubber band 56 or other holding means when an arrow is inserted into the barrel 19 as illustrated in broken line in FIG. 7 thereby rolling the rubber band 56 out of the notches 62 to its rolled-off position shown in full line in FIG. 7. However, since the outer tips of the fins 58 will be engaging in the corners of the barrel 19 as shown in FIG. 9 the sabot 53 will be retained in its assembled position on the arrow shaft 51 until the arrow exits the muzzle of the barrel 19. Thereupon, the two halves 57—57 of the sabot 53 will be free to fall from the arrow shaft as illustrated in FIG. 11. The halves 57 may be inexpensively formed from plastic by injection molding so as to be either expendable or they ca be recovered and reused by the archer.

Figure 6:
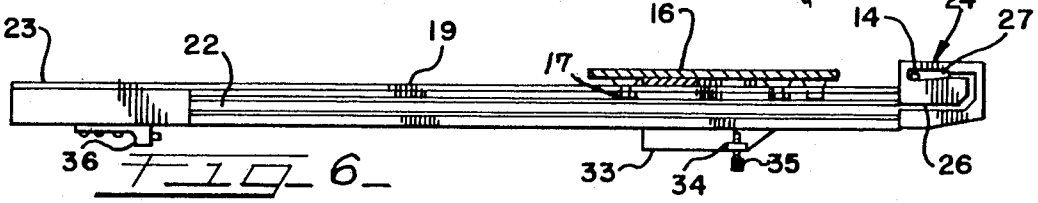
FIG. 6 is a top plan view, partly in section, of the barrel-like guiding and launching device.
Figure 4:
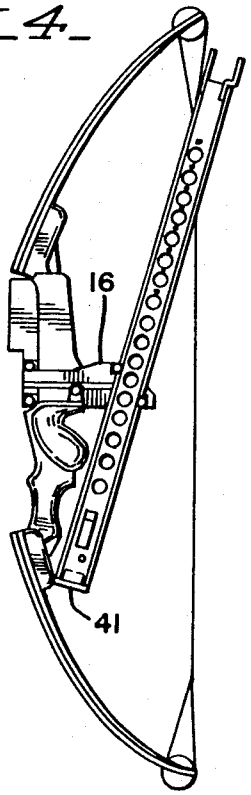
FIG. 4 is a side elevational view showing the barrel of the guiding and launching device in its folded or stowed position with respect to the bow.

In use, the barrel 19 is assembled to the bow 10 in the position shown in FIGS. 1, 2, 5 and 11 with the bow string 14 passing through the slot 22. The user then places the bow string 14 into the retaining slot 27 (FIG. 6). An arrow 50 is then inserted into the breach end of the barrel 19 as illustrated in FIGS. 5 and 7 with the nock 55 of the arrow protruding from the breach end of the barrel 19 and the sabot 54 fully inserted into the breach end of the barrel thereby causing the rubber band 56 to engage the shanks 70 (FIGS. 7 and 9) of the screws 64 and roll the rubber band off from the sabot 53. When it is desired to shoot or release an arrow 50, the user pushes the barrel 19 forward sufficiently to allow the bow string 14 to slide out of slot 27 (FIG. 6) and move into the groove 26. The arrow nock 55 is next attached to the bow string 14. The user now draws the string 14 rearwardly by grasping the string about the nock 55 rolls the barrel 1 back until the rubber bumper 40 engages the bumper stop 35. With the bow thus being fully drawn the user releases the string 14 from his grasp thereby allowing the bow action to take over and propel the arrow 50 through the barrel 19 and launch the arrow with a guided action during its passage. The barre remains in place with the bumper 40 engaging the stop 35 until the user pushes it forward.

As mentioned above, since the arrow 50 is substantially shorter and thereby has less weight than a conventional arrow, it will be propelled with greater velocity and have greater range and accuracy and flatter trajectory than if shot from the bow 10 without the use of the guiding action during its launch that is provided by the barrel 19

It will be apparent that in addition to those already mentioned, a number of other changes may be made in the foregoing embodiment of the invention without departing from the spirit and scope of the following claims. Thus, the shanks 70 of the screws 64 may be replaced with sharp blades which will sever the rubber band 56 or other retainer. Instead of using sabots having four fins one for each corner of the square barrel 19, other sabots with two or more fins could be used with appropriate barrels. Further, sabots with a plurality of fins could be used in cylindrical barrels.

What is claimed is:

1. A device for mounting on an archery bow for guiding the launch of an arrow carrying a finned sabot, comprising:

a straight elongated arrow launching barrel having a breach end and a muzzle end with a vertical bow string accommodating slot extending from at or adjacent said breach end to or adjacent said muzzle end, said barrel having a straight opening extending from end-to-end therethrough and having a cross-section substantially greater than that of the shaft of said arrow and sized to provide guiding action on the fins of said sabot as said arrow passes therethrough; and, means for reciprocally mounting said barrel on a bow so that said barrel and an arrow disposed therein for launching may be drawn back with said bow string to the cocked position wherefrom said arrow can be released for flight while said barrel thereafter remains retracted until advanced for reloading.

2. In the device called for in claim 1, means for limiting the extent to which said barrel may be drawn back comprising members which engage each other, one being a first member mounted on said barrel and the second being a member mounted on said means for reciprocally mounting said barrel.

3. In the device as called for in claim 2, wherein at least one of said members is adjustably positioned s as to adjust the distance said barrel may be drawn back.

4. In the device as called for in claim 1, said barrel having a square cross-section and being formed by a pair of channel members and means rigidly interconnecting said channels adjacent the breach and muzzle ends of said barrel in spaced relationship so as to provide a vertical slot through said barrel for accommodating the string of said bow.

5. In the device as called for in claim 1, said means for reciprocally mounting said barrel being integrally formed with the riser of said archery bow and including a vertical bearing plate on which are mounted a pair of horizontally aligned upper support rollers and a pair of horizontally aligned lower support rollers, said pairs of rollers being vertically spaced as to receive and support said barrel therebetween.

6. In the device as called for in claim 5, said support rollers and said barrel having interengaging formation that prevent said barrel from having relative movement with respect to said bow other than reciprocal movement.

7. In the device as called for in claim 6, said interengaging formations being in the form of longitudinal ribs on said barrel and circumferential grooves in said support rollers.

8. In the device as called for in claim 5, said means for reciprocally mounting said barrel having a horizontal flange, a first stop member mounted on said horizontal flange, and a second stop member mounted on said barrel adjacent its muzzle end, said stop members being aligned so as to engage each other when said barrel is drawn back in hooting an arrow with said deice.

9. In the device as called for in claim 5, means attached to said riser for releasably engaging and supporting the muzzle end of said barrel, and a set of said upper and lower support rollers being horizontally spaced so as to support said barrel therebetween thereby providing three-point support for said barrel in a folded relationship to said bow

10. In the device as called for in claim 9, said means for releasably engaging and supporting the muzzle end of said barrel having a plug which fits into said barrel.

11. In the device called for in claim 1, a bow retention member mounted on the breach end of said barrel and string guide and having a multi-section slot therein, one section being aligned with bow string accommodating slot in said barrel and another section being a blind for retaining the bow string therein for arrow loading.

12. In combination, an archery arrow bow and a device for mounting thereon as called for in claim 1.

13. In combination, an archery bow, a device for mounting thereon as called for in claim 1, and an archery arrow launchable through said barrel of said device and having at least one sabot mounted on said arrow.

14. A device for mounting on an archery bow for guiding the launch of an arrow having fletchings or fins on its nock end and carrying a finned sabot adjacent its front end and for causing the release and separation of said sabot form said arrow as it leaves said device and begins its free flight, comprising:

a straight elongated arrow launching barrel having arrow nock-receiving breach end and a muzzle end with a vertical bow string accommodating slots extending from said beach and to adjacent said muzzle end, said barrel having straight opening extending from end-to-end through said barrel and having an inside cross-section substantially greater than that of the shaft of said arrow and sized to provide guiding action on the fins of said sabot and on the fletchings or fins on the nock end of said arrow as said arrow passes therethrough; and, means for reciprocally mounting said barrel on a bow so that said barrel and an arrow disposed therein for launching may be drawn back with said bow string to the cocked position wherefrom said arrow can be released for flight while said barrel remains retracted until advanced for reloading; and means disposed within said barrel end for releasing said sabot from said arrow and thereby allowing said sabot to separate from said arrow as said sabot exits form the muzzle end of guide.

15. An archery arrow and sabot combination for shooting from a bow with a launching barrel, comprising:

an arrow having a shaft with a nock end and a tip end; and at least one sabot mounted on said arrow which separates form said arrow as it leaves said launching barrel.

16. The archery arrow and sabot combination called for in claim 15, wherein said at least one sabot is mounted on said arrow adjacent to or on its tip end.

17. The archery arrow and sabot combination called for in 15, wherein there are two sabots one mounted adjacent the tip end of the arrow and the other being mounted adjacent the nock end of the arrow.

18. An archery arrow and sabot combination comprising:

an arrow having a shaft with a nock end and a tip end;

at least one sabot mounted on said arrow, and wherein said sabot is formed in a assembly of multi-parts and a retention means retains said parts in assembled relationship, said retention means being removable and said parts separating from said arrow in free flight.

* * * * *

UNITED STATES PATENT AND TRADEMARK OFFICE
CERTIFICATE OF CORRECTION

PATENT NO. : 4,829,974

DATED : May 16, 1989

INVENTOR(S) : Jeffrey R. Anderson

It is certified that error appears in the above-identified patent and that said Letters Patent is hereby corrected as shown below:

Column 1, line 49, delete "tee" and insert --the--.

Column 2, line 3, delete "add" and insert --and--.

Column 3, line 3, delete "tee" and insert --the--.

Column 3, line 62, after "and", insert --a--.

Column 3, line 66, delete "Tee" and insert --The--.

Column 4, line 2, delete "tee" and insert --the--.

Column 4, line 7, "1" should be --19--.

Column 4, line 12, delete "t" and insert --to--.

Column 4, line 27, delete "add" and insert --and--.

Column 5, line 9, delete "ca" and insert --can--.

Column 5, line 29, "1" should be --19--.

Column 5, line 34, "barre" should read --barrel--.

Column 5, line 43, after 19, insert "."

UNITED STATES PATENT AND TRADEMARK OFFICE

CERTIFICATE OF CORRECTION

PATENT NO. : 4,829,974

DATED : May 16, 1989

INVENTOR(S) : Jeffrey R. Anderson

It is certified that error appears in the above-identified patent and that said Letters Patent is hereby corrected as shown below:

Claim 3, line 2, delete "s" and insert --so--.

Claim 6, line 2, "formation" should read --formations--.

Claim 8, line 7, "hooting" should read --shooting--, and "deice" should read --device--.

Claim 9, line 7, after "bow", insert ".".

Claim 11, line 1, after "bow" and before "retention", insert --string guide and--.

Claim 11, line 3, delete "string guide and".

Claim 14, line 5, "form" should read --from--.

Claim 14, line 10, "beach and" should read --breach end--.

Claim 14, line 11, after "having" insert --a--.

Claim 14, last line, "form" should read --from--.

UNITED STATES PATENT AND TRADEMARK OFFICE

CERTIFICATE OF CORRECTION

PATENT NO. : 4,829,974

DATED : May 16, 1989

INVENTOR(S) : Jeffrey R. Anderson

It is certified that error appears in the above-identified patent and that said Letters Patent is hereby corrected as shown below:

Claim 15, line 7, "form" should read --from--.

Claim 17, line 2, after "in", insert --claim--.

Signed and Sealed this

Eighteenth Day of December, 1990

*Attest:*

HARRY F. MANBECK, JR.

*Attesting Officer*

*Commissioner of Patents and Trademarks*